US005186552A

United States Patent [19]

Stevenin et al.

[11] Patent Number: 5,186,552

[45] Date of Patent: Feb. 16, 1993

[54] DOT MATRIX PRINT HEAD

[75] Inventors: Gino Stevenin, Gaby; Contardo Adamoli, Castellamonte, both of Italy

[73] Assignee: Microlys S.p.A., Ivrea, Italy

[21] Appl. No.: 849,777

[22] Filed: Mar. 12, 1992

[30] Foreign Application Priority Data

Mar. 19, 1991 [IT] Italy ..... 000199 A/91

[51] Int. Cl.[5] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,382,701 | 5/1983 | Davenport | 101/93.05 |
| 4,568,207 | 2/1986 | Hara et al. | 400/124 |
| 4,572,681 | 2/1986 | Miyazawa et al. | 101/93.05 |
| 4,810,112 | 3/1989 | Gariado | 400/124 |
| 4,895,464 | 9/1990 | Rubinshstein | 400/124 |
| 5,054,942 | 10/1991 | Bernardis et al. | 400/124 |

FOREIGN PATENT DOCUMENTS

| | | | |
|---|---|---|---|
| 123675 | 7/1984 | Japan | 101/93.05 |

*Primary Examiner*—Edgar S. Burr
*Assistant Examiner*—Ren Yan
*Attorney, Agent, or Firm*—Baker & Daniels

[57] ABSTRACT

A dot matrix print head wherein each printing device comprises a pin fitted to one end of the anchor of a respective electromagnet. The electromagnet presents an E-shaped core, the center bar of which forms a first pole piece, and the other two bars of which form the other pole piece coplanar with the first. The anchor consists of a plate having a flat surface designed to rest on the first pole piece and defined by two parallel steps. The first step is located on a portion opposite the end fitted with the pin, and rests on the other pole piece. The other step is adjacent to the aforementioned end, and corresponds with the gap between the center bar and a lateral bar of the core, so as to enable overtravel of the plate and the pin for effecting a ballistic print stroke.

8 Claims, 4 Drawing Sheets

DOT MATRIX PRINT HEAD

BACKGROUND OF THE INVENTION

The present invention relates to a dot matrix print head having a number of selectively activatable printing devices, each comprising a printing element fitted to one end of the anchor of a respective electromagnet.

For improving the character definition of print heads of the aforementioned type, each printing element may be controlled by a ballistic actuator in such a manner that the final portion of the print stroke is performed inertially. For this purpose, the printing element of a normal print head is connected to the anchor of the electromagnet by means of a one-way joint, so that the anchor is arrested sharply by the electromagnet core, while the printing element continues moving. A major drawback of joints of the aforementioned type is the wear induced on the two contacting parts, which inevitably impairs the accuracy and increases the noise level of the print head.

SUMMARY OF THE INVENTION

It is an object of the present invention to provide a straightforward "ballistically" activated dot matrix print head designed to overcome the aforementioned drawbacks.

According to the present invention, there is provided a dot matrix print head, the electromagnet of which presents a core of magnetic material having two coplanar pole pieces; the anchor consisting of a plate pivoting on a pin and substantially perpendicular to the operating direction of the printing element, and having a flat surface designed to rest on one of said pole pieces; said flat surface being defined, on one side, by a first edge normally maintained contacting the other of said pole pieces; characterized by the fact that said flat surface is defined, on the other side, by a second edge parallel to said first edge and designed to enable overtravel of said plate for producing a ballistic stroke of said printing element.

BRIEF DESCRIPTION OF THE DRAWINGS

A preferred non-limiting embodiment of the present invention will be described by way of example with reference to the accompanying drawings, in which.

DETAILED DESCRIPTION OF THE INVENTION

Figure 1:
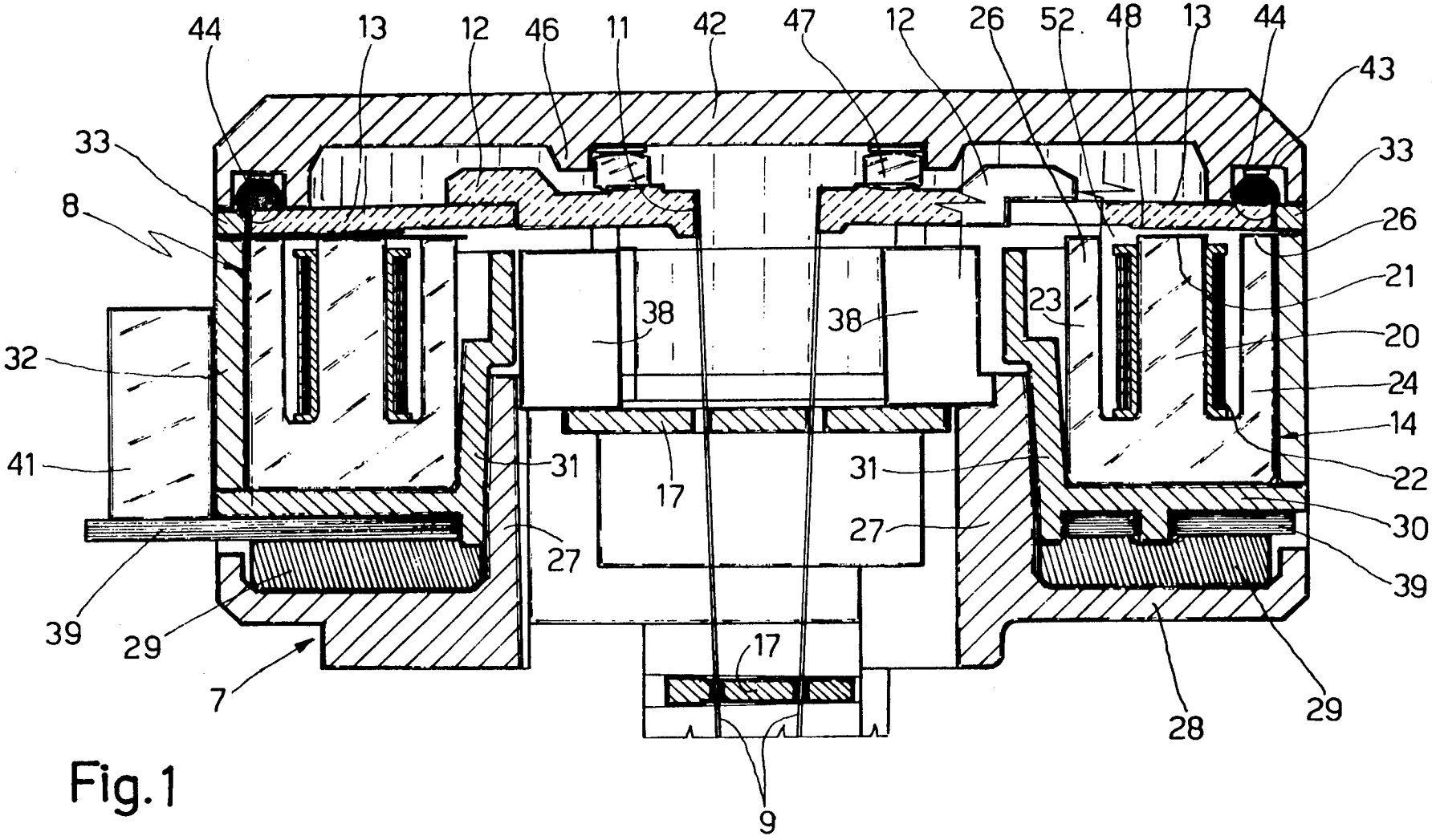
FIG. 1 shows a cross section of a dot matrix print head in accordance with the present invention.

Number 7 in FIG. 1 indicates a supporting body for a number of printing devices 8, each comprising a pin 9 fitted to the edge 11 of a blade 12 (FIG. 3) in turn fitted to the anchor 13 of an electromagnet 14.

Anchor 13 consists of a plate of ferromagnetic material perpendicular to blade 12, and one end 16 (FIG. 4) of which is fitted, e.g. welded, to the end of blade 12 opposite edge 11. Pins 9 (FIG. 1) are guided towards a print matrix (not shown) through respective holes in a number of guide plates 17 (only two of which are shown in FIG. 1).

Figure 3:
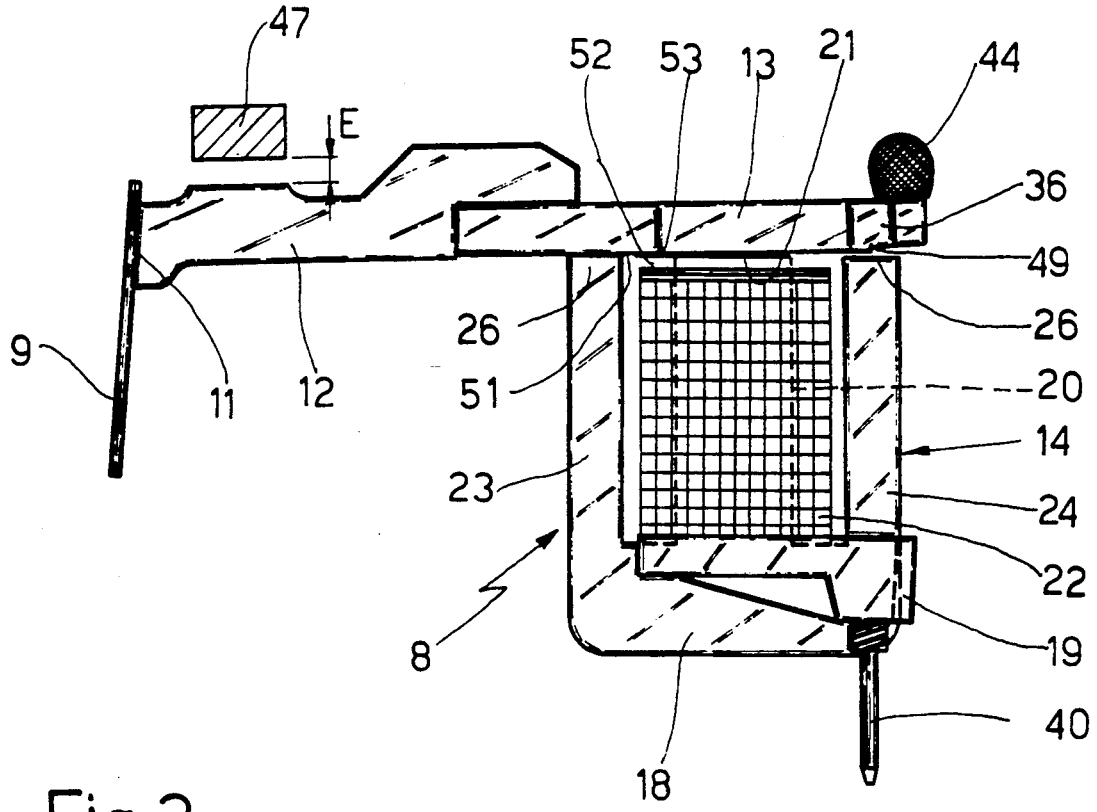
FIG. 3 shows a side view of one of the printing elements on the head in one operating position.

Each electromagnet 14 comprises a core consisting of a pack of ferromagnetic laminations 18 supported on a reel 19 (FIG. 3). Laminations 18 are E-shaped, and comprise a center bar 20 constituting a first pole piece 21 of a core of electromagnet 14. The usual electric coil 22 for energizing electromagnet 14 is supported on bar 20 and wound about reel 19. The other two lateral bars 23 and 24 form the other pole piece 26 of the core, which is substantially coplanar with pole piece 21.

Body 7 (FIG. 1) comprises an inner sleeve 27 housing guide plates 17 and pins 9; and an annular flange 28 housing a soundproofing ring 29. Ring 29 is fitted on top with the flange 30 of a further sleeve 31, which, together with flange 30, provides for internally supporting electromagnets 14.

Figure 2:
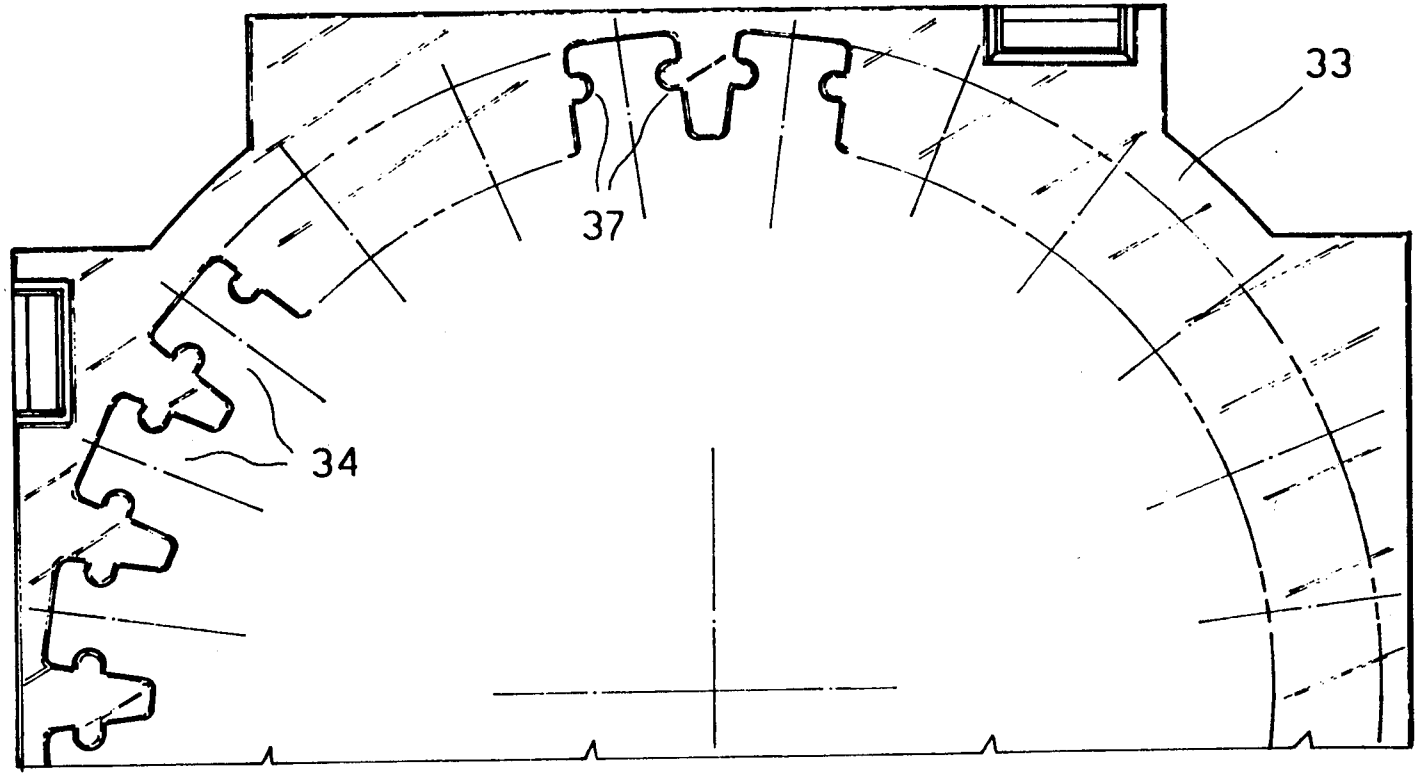
FIG. 2 shows a front view of a detail in FIG. 1.
Figure 4:
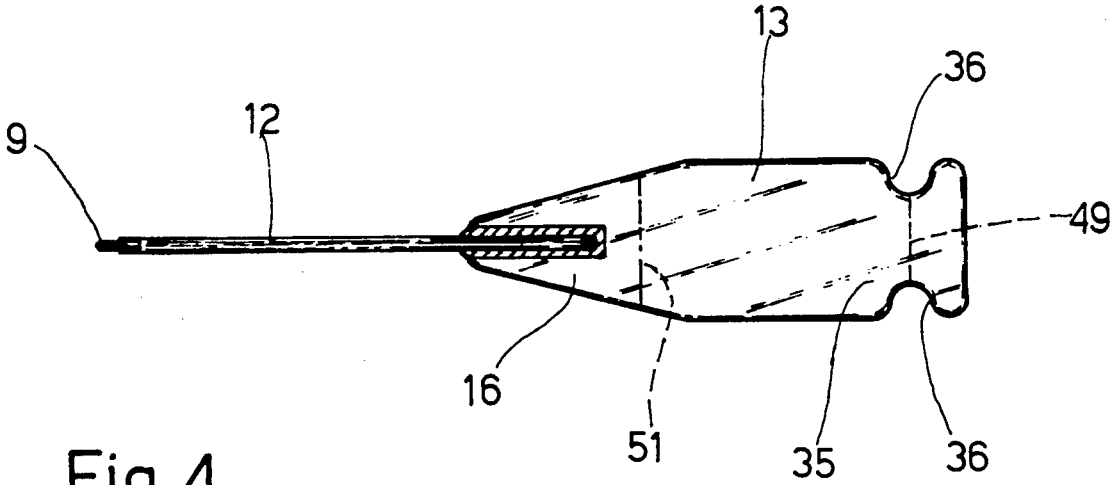
FIG. 4 shows a front view of a detail of FIG. 3.

Electromagnets 14 are also enclosed laterally by a tubular casing 32 closed on top by a ring 33 (FIG. 2) having a number of radial openings 34, each housing a portion 35 of plate 13 opposite end 16 (FIG. 4). In particular, plate 13 presents two opposite grooves 36 engaging respective appendixes 37 in opening 34 (FIG. 2).

Body 7 (FIG. 1) also presents a number of spring elements 38, e.g. flexible pins, each acting on a respective blade 12 for resetting pin 9 to the idle position after each operation; and an electric printed circuit board 39 connected to coils 22 by means of a respective pin 40 (FIG. 3), and connected by electrical connector 41 (FIG. 1) to the drive circuit of the print head, for selectively energizing coils 22. Body 7 therefore supports an assembly comprising plates 13, spring elements 38, electromagnets 14 and printed circuit 39.

The print head is closed by a cover 42 connected to body 7, e.g. by means of bolts parallel to the axis of body 7, and having a groove 43 housing a round-section ring 44 of elastomeric material acting as a pin for portion 35 of plate 13 (FIG. 4).

Cover 42 (FIG. 1) also presents an annular rib 46 housing a barrel-section ring 47 for arresting blade 12 in the idle position to which it is thrust by spring element 38 or drawn by compressing cover 42 on elastic ring 44.

Cover 42 therefore supports a further assembly comprising elastic rings 44 and 47.

Plate 13 presents a flat surface 48 designed to rest on pole piece 21, and defined on one side (to the right in FIGS. 3 and 4) by a first edge consisting of a step 49 located on portion 35 of plate 13, substantially opposite ring 44, and preferably corresponding with bar 24 of laminations 18.

On the other side adjacent to end 16, surface 48 of plate 13 is defined by a second edge consisting of a step 51 parallel to step 49 and corresponding with the gap 52 between center bar 20 and lateral bar 23 of laminations 18. Steps 49 and 51 may present the same height H (FIG. 6) preferably ranging from 0.05 to 0.1 mm.

Printing device 8 operates as follows.

Figure 5:
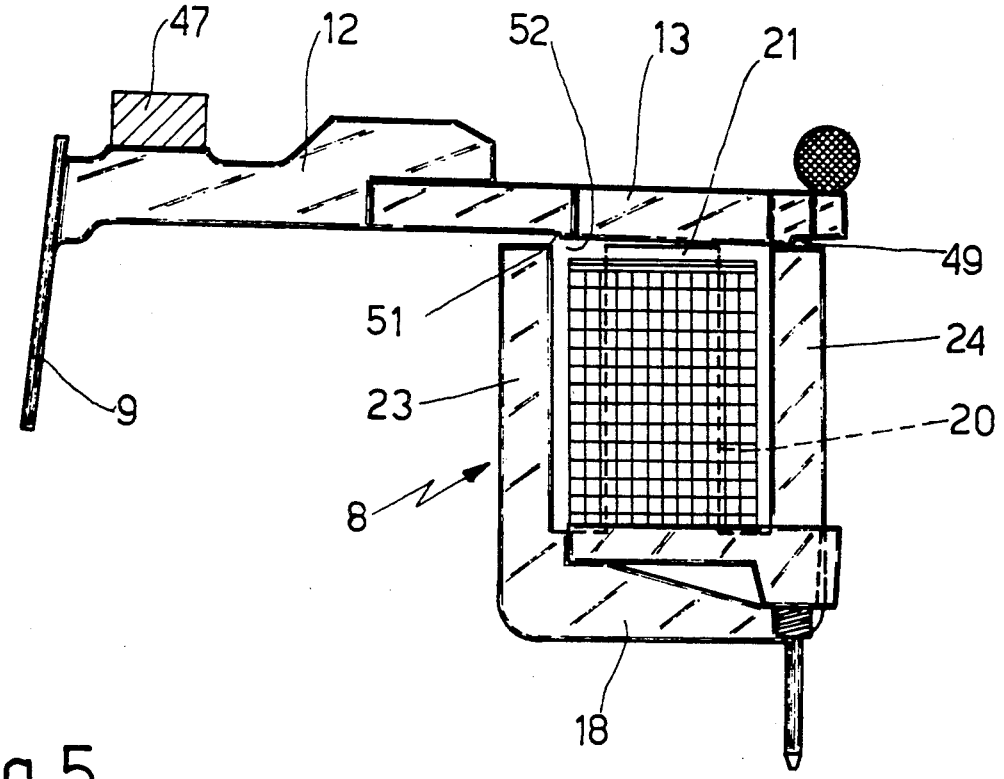
FIGS. 5 and 6 show the FIG. 3 printing element in a further two operating positions.

In idle mode, coil 22 of respective electromagnet 14 is de-energized; spring element 38 holds respective blade 12 against ring 47; and elastic ring 44 holds edge 49 of plate 13 against bar 24 of laminations 18 and, therefore, against the other pole piece 26, as shown in FIG. 5. In the absence of spring element 38, blade 12 is maintained contacting ring 47 by compressing elastic ring 44, by virtue of the lever arm between the axis of ring 44 and edge 49.

Figure 6:
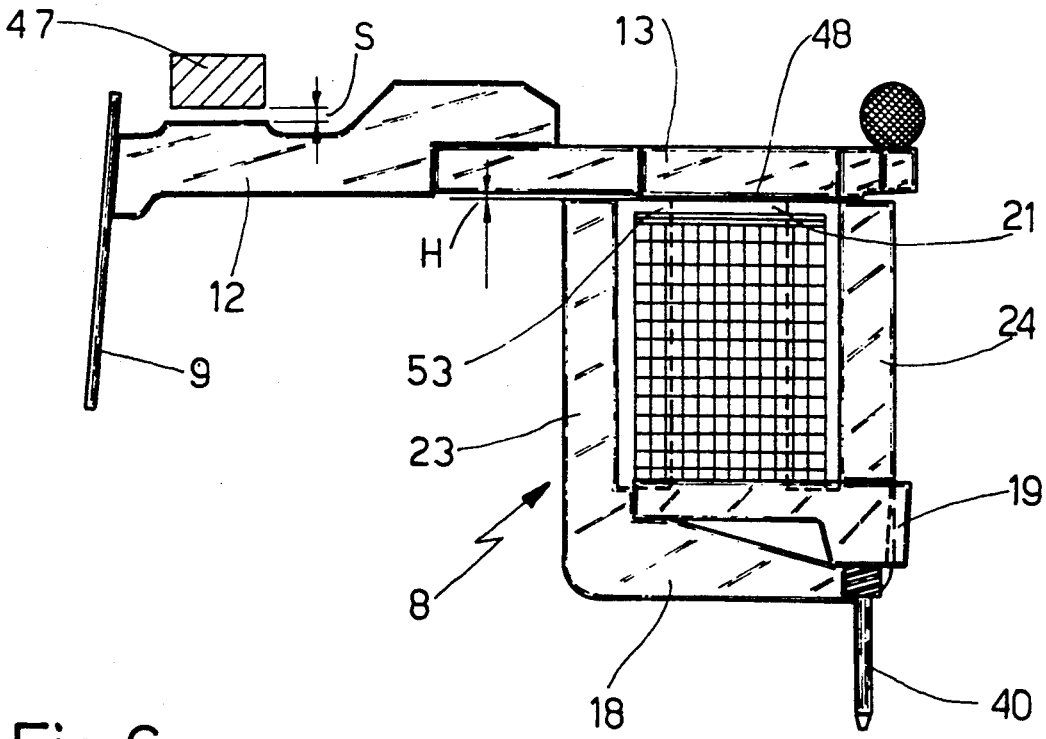

When coil 22 is energized, plate 13 rotates anticlockwise in FIG. 5 about ring 44, so as to effect a so-called "static" stroke S, and bring flat surface 48 to rest on pole piece 21, as shown in FIG. 6. Plate 13 may be so sized and positioned as to produce a static stroke S of pin 9 of 0.35 mm.

Due to inertia, the assembly consisting of pin 9, blade 12 and plate 13 continues rotating about edge 53 of pole piece 21, adjacent to step 51, thus resulting in overtravel E of pin 9 (FIG 3) and a ballistic stroke of the printing element.

Overtravel E is made possible by step 51 corresponding with gap 52 between bars 20 and 23 of laminations 18. Though the height H of step 51 is such as to enable a maximum overtravel E of pin 9 of approximately 0.25 mm, pin 9 is normally arrested slightly short of the maximum limit.

The overtravel of pin 9 causes portion 35 of plate 13 to compress ring 44. Following the print stroke, pin 9, assisted by spring element 38 (if provided) and by the elastic action produced by compressing ring 44, springs back to restore plate 13 rapidly to the idle position, by rotating it clockwise in FIG. 6, first about edge 53 of pole piece 21, and then about edge 49 of plate 13.

The advantages of the print head according to the present invention will be clear from the foregoing description. The rigid connection of blade 12 and plate 9, 13 provides for increasing the mass of the ballistic assembly, thus improving printing quality, while at the same time eliminating wear of the one-way joint components between blade 12 and plate 13.

To those skilled in the art it will be clear that changes may be made to the print head as described and illustrated herein without, however, departing from the scope of the present invention. For example, the position of elastic pin 44 in relation to step 49 may be altered to increase the lever arm, and so eliminate spring element 38 for restoring printing element 9, 12 to the idle position.

What is claimed is:

1. A dot matrix print head comprising a number of printing devices and a number of corresponding electromagnets for selectively activating the printing devices, each said electromagnet comprising an anchor consisting of a plate pivotally cooperating with a ring support and a core of magnetic material having first and second coplanar pole pieces, and each said printing device comprising a printing element fitted to one end of the anchor of the associated electromagnet and having an operating direction, the anchor being substantially perpendicular to the operating direction of said printing element and having a flat surface cooperating with said first and second pole pieces; wherein each said core is E-shaped and comprises a central bar defining an edge forming said first pole piece, and first and second opposite lateral bars spaced apart from the central bar and defining different parts of said second pole piece; and said flat surface of the anchor having first and second opposite steps disposed parallel to each other, said first step being provided substantially in correspondence with said ring support for pivoting, when the anchor is in a rest position in which the electromagnet is de-energized, on said first lateral bar of the core, said second step being provided in correspondence with a gap between the central bar and said second lateral bar of the core so as to enable said anchor to overtravel pivoting on said edge of said central bar of the core for producing a ballistic stroke of the associated printing element.

2. The print head of claim 1, wherein each said printing element comprises a needle fitted to a blade, the blade being fitted to said anchor on a side of the anchor which is provided with said second step; said ring support acting on said anchor in a position substantially opposite to said first step.

3. The print head of claim 2, wherein said E-shaped core consists of a pack of E-shaped laminations forming said central and said opposite lateral bars, said central bar supporting an electric coil of the electromagnet.

4. The print head of claim 3, wherein said first and second opposite steps are formed with a height between 0.05 and 0.1 mm.

5. The print head of claim 1, wherein said printing devices are disposed circumferentially in a hollow body having a top, said hollow top closed by a guide ring having radial openings, said radial openings formed with two appendices and housing said anchor, said anchor having two lateral grooves engaging said two appendices in an associated said radial opening in said guide ring.

6. The print head of claim 5, wherein said hollow body also houses an inner support for said electromagnets, and a plurality of elastic elements for retracting said printing elements.

7. The print head of claim 6, further comprising a soundproofing ring for said printing devices, said soundproofing ring disposed between said inner support and said hollow body.

8. The print head of claim 5, wherein said hollow body is closed by a cover which houses an elastic ring forming a pin of said anchor, and further comprising a stop ring for arresting the return stroke of said print elements.

* * * * *